US007169045B2

(12) United States Patent
Nordman

(10) Patent No.: US 7,169,045 B2
(45) **Date of Patent: *Jan. 30, 2007**

(54) GAMING DEVICE WITH ROTATING DISPLAY AND INDICATOR THEREFORE

(75) Inventor: Dennis Nordman, Lake Villa, IL (US)

(73) Assignee: IGT, Reno, NV (US)

( * ) Notice: Subject to any disclaimer, the term of this patent is extended or adjusted under 35 U.S.C. 154(b) by 253 days.

This patent is subject to a terminal disclaimer.

(21) Appl. No.: 10/800,593

(22) Filed: Mar. 15, 2004

(65) Prior Publication Data

US 2004/0180715 A1 Sep. 16, 2004

Related U.S. Application Data

(63) Continuation of application No. 10/243,050, filed on Sep. 12, 2002, now Pat. No. 6,712,694.

(51) Int. Cl.
*G07F 17/34* (2006.01)

(52) U.S. Cl. ..... 463/20; 463/16; 273/143 R; 273/138.2

(58) Field of Classification Search ..... 273/143 R, 273/138.1, 138.2; 463/20, 25, 46, 16
See application file for complete search history.

(56) References Cited

U.S. PATENT DOCUMENTS 2,545,644 A 3/1951 Benton et al.
3,975,022 A 8/1976 Figueroa
4,410,178 A 10/1983 Partridge
4,695,053 A 9/1987 Vazquez, Jr. et al.
4,732,386 A 3/1988 Rayfiel
5,058,893 A 10/1991 Bertram et al.
5,152,529 A 10/1992 Okada (Continued)

FOREIGN PATENT DOCUMENTS

AU 199650720 10/1996

(Continued)

OTHER PUBLICATIONS

4DU Dice Unit Advertisement written by starpoint.uk.com, printed on Sep. 3, 2002.

(Continued)

*Primary Examiner*—Benjamin Layno
(74) *Attorney, Agent, or Firm*—Bell, Boyd & Lloyd LLC

(57) ABSTRACT

A mechanical display and a mechanical indicator for gaming devices includes various embodiments, each of which have a number of elements in common. First, the embodiments each include a rotating set of symbols or indicia. Second, each of the embodiments includes an oscillating indicator, such as an arrow. The symbols rotate, appear and disappear from the player's view. In this manner, the player sees each of the symbols and hopes that the gaming device awards the symbol having the highest or best value. The one or more indicators move in a sequence to point out or indicate one of the symbols or one of the groups of symbols. The indicators provide a second random, visual element to the outcome, wherein the player's attention must account for both the changing symbols and the moving indicators. The symbol eventually indicated produces, at least in part, a game outcome.

68 Claims, 10 Drawing Sheets

U.S. PATENT DOCUMENTS

| | | | |
|---|---|---|---|
| 5,364,100 | A | 11/1994 | Ludlow et al. |
| 5,395,111 | A | 3/1995 | Inoue |
| 5,449,173 | A | 9/1995 | Thomas et al. |
| 5,560,603 | A | 10/1996 | Seelig et al. |
| 5,584,763 | A | 12/1996 | Kelly et al. |
| 5,664,998 | A | 9/1997 | Seelig et al. |
| 5,823,872 | A | 10/1998 | Prather et al. |
| 5,823,874 | A | 10/1998 | Adams et al. |
| D400,597 | S | 11/1998 | Hedrick et al. |
| D402,702 | S | 12/1998 | Seelig et al. |
| 5,848,932 | A | 12/1998 | Adams |
| D406,865 | S | 3/1999 | Heidel |
| 5,882,261 | A | 3/1999 | Adams |
| 5,911,418 | A | 6/1999 | Adams et al. |
| 5,927,714 | A | 7/1999 | Kaplan |
| 5,976,015 | A | 11/1999 | Seelig et al. |
| 6,004,207 | A | 12/1999 | Wilson, Jr. et al. |
| 6,059,658 | A | 5/2000 | Mangano et al. |
| 6,086,066 | A | 7/2000 | Takeuchi et al. |
| 6,089,977 | A | 7/2000 | Bennett |
| 6,089,978 | A | 7/2000 | Adams |
| 6,105,962 | A | 8/2000 | Malavazos et al. |
| 6,113,098 | A | 9/2000 | Adams |
| 6,142,873 | A | 11/2000 | Weiss et al. |
| 6,142,874 | A | 11/2000 | Kodachi et al. |
| 6,159,098 | A | 12/2000 | Slomiany et al. |
| 6,162,121 | A | 12/2000 | Morro et al. |
| 6,173,955 | B1 | 1/2001 | Perrie et al. |
| 6,203,429 | B1 | 3/2001 | Demar et al. |
| D441,031 | S | 4/2001 | Seelig et al. |
| 6,213,876 | B1 | 4/2001 | Moore, Jr. |
| 6,220,593 | B1 | 4/2001 | Pierce et al. |
| 6,224,483 | B1 | 5/2001 | Mayeroff |
| 6,227,970 | B1 | 5/2001 | Shimizu et al. |
| D443,313 | S | 6/2001 | Brettschneider |
| 6,251,013 | B1 | 6/2001 | Bennett |
| 6,254,481 | B1 | 7/2001 | Jaffe |
| 6,267,669 | B1 | 7/2001 | Luciano, Jr. et al. |
| 6,270,411 | B1 | 8/2001 | Gura et al. |
| 6,302,790 | B1 | 10/2001 | Brossard |
| 6,305,686 | B1 | 10/2001 | Perrie et al. |
| 6,315,663 | B1 | 11/2001 | Sakamoto |
| 6,336,863 | B1 | 1/2002 | Baerlocher et al. |
| 6,340,158 | B2 | 1/2002 | Pierce et al. |
| 6,368,216 | B1 | 4/2002 | Hedrick et al. |
| 6,386,974 | B1 | 5/2002 | Adams |
| 6,398,220 | B1 | 6/2002 | Inoue |
| 6,419,579 | B1 | 7/2002 | Bennett et al. |
| 6,461,241 | B1 | 10/2002 | Webb et al. |
| D465,531 | S | 11/2002 | Luciano, Jr. et al. |
| 6,481,713 | B2 | 11/2002 | Perrie et al. |
| 6,517,432 | B1 | 2/2003 | Jaffe |
| 6,533,660 | B2 | 3/2003 | Seelig et al. |
| 6,537,152 | B2 | 3/2003 | Seelig et al. |
| 6,582,307 | B2 | 6/2003 | Webb |
| 6,609,972 | B2 | 8/2003 | Seelig et al. |
| 2001/0024971 | A1 | 9/2001 | Brossard |

FOREIGN PATENT DOCUMENTS

| | | | |
|---|---|---|---|
| EP | 1 003 138 | A | 5/2000 |
| GB | 912685 | | 12/1962 |
| GB | 2 201 821 | A | 9/1988 |
| GB | 2 287 567 | A | 9/1995 |
| GB | 2 383 668 | A | 7/2003 |

OTHER PUBLICATIONS

American Bandstand Brochure written by Anchor Games, published in 2001.

Big Shot!™ Advertisement published by Aristocrat Technologies, Inc., published in 2002.

Big Top Keno Advertisement published by Aristocrat Technologies, Inc., published in 2000.

Bonus Roulette Brochure written by F. Franco, not dated.

Buck's Roulette Brochure written by R. Franco, not dated.

Chariot's of Fortune Brochure written by R. Franco, not dated.

Classic Pot of Gold Brochure written by Ace Coin Equipment Ltd., not dated.

Cyberdyne Gaming Brochure written by Cyberdyne Gaming, not dated.

Elvira® Mistress of the Dark™ Advertisement written by IGT, published in 2002.

Elvis Hits Advertisement written by IGT, published in 1999.

Holy Smoke Brochure written by Impulse Gaming Ltd., not dated.

Jack and the Beanstalk™ Brochure written by AC Coin & Slot, not dated.

King of the Grill™ Brochure written by AC Coin & Slot, not dated.

Line-Up Brochure written by AC Coin & Slot, not dated.

Little Green Men Jr.™ Advertisement written by AC Coin & Slot, not dated.

Little Green Men Jr.™ Article written by Strictly Slots, published in Feb. 2003.

Miss America Brochure written by AC Coin & Slot, not dated.

Mix and Match Article written by Strictly Slots, published in Apr. 2002.

Mix and Match Advertisement published by AC Coin & Slot, not dated.

Money Grab Article written by Strictly Slots, published in Apr. 2001.

Monster Match Article written by Strictly Slots, published in Jan. 2002.

On The Money! Article written by Strictly Slots, published in Dec. 2000.

Payout!™ Advertisement written by www.csds.com/Gaming Products/g Payout.htm, printed on Jan. 15, 2001.

Payout!™ Article written by Casino Data Systems, not dated.

Pick a Prize Brochure written by Acres Gaming Incorporated, published prior 2001.

Power Slotto Brochure published by AC Coin & Slot prior to 2002.

Press Your Luck Brochure published by AC Coin & Slot prior to 2002.

Quick Pick Paytime Brochure written by Acres Gaming Incorporated, published prior to 2001.

R&B™ Brochure published by AC Coin & Slot, not dated.

Reel Dice Advertisement written by Gerber & Glass, published in 1936.

Royal Roulette Brochure written by Impulse Gaming Ltd., not dated.

Slot Machine Buyer's Handbook, A Consumer's Guide to Slot Machines written by David L. Saul and Daniel R. Mead, published in 1998.

Silver City Roundup Brochure published by AC Coin & Slot, not dated.

Slot Machines A Pictorial History of the First 100 Years, 5th edition written by Marshall Fey, published in 1983-1997.

Slot Machines on Parade, 1st edition written by Robert N. Geddes and illustrated by Daniel R. Mead, published in 1980.

Spin-A-Lot Brochure written by Acres Gaming Incorporated, published prior to 2001.

Take Your Pick Article written by Strictly Slots, published in Mar. 2001.

Yahtzee Bonus Advertisement written by Mikohn, published in 1999.

GAMING DEVICE WITH ROTATING DISPLAY AND INDICATOR THEREFORE

PRIORITY CLAIM

This application is a continuation of and claims priority to and the benefit of U.S. patent application Ser. No. 10/243,050, filed on Sep. 12, 2002 now U.S. Pat. No. 6,712,694, which is incorporated herein in its entirety.

BACKGROUND OF THE INVENTION

The present invention relates to gaming devices. More particularly, the present invention relates to wagering gaming device displays.

Gaming devices provide fun and excitement to the player. Gaming, in general, provides an escape from the everyday rigors of life. Gaming devices and gaming establishments use bright lights and exciting sounds to set the gaming world apart from the rest of the world. Gaming devices, in particular, use one or more displays that enable the player to see and play the game. The displays typically portray the action of the game and ultimately indicate whether or not the player wins.

Slot machine displays have gone through a number of transitions since their inception in the late 1800's. Originally, slot machines displayed purely mechanical reels. While these machines gained enormous popularity, the mechanical nature of the reels limited the number of paystops, which limited the number of different symbols and the number of different winning symbol combinations.

The advent of the computer and the video monitor expanded the possibilities for gaming devices. There are now video poker, video blackjack and other types of video gaming machines. Video displays have also been implemented in slot machines. The video slot machines use computers to randomly generate symbol combinations from an expanded number of different symbols. Video reel strips can include a virtually unlimited number of symbols, which enables a wide variety of different symbol combinations to be employed, including combinations that appear very infrequently and yield high payouts.

With slot machines, the video monitors have also been used to provide bonus or secondary games. Bonus games have become much more prevalent and elaborate in recent years. Players play the base game of slot until becoming eligible for a bonus game. The base game temporarily pauses, while the player plays the bonus game. When the player completes the bonus game, the gaming device returns the player to the bonus game.

It should therefore be appreciated that a single video monitor is often sufficient to provide both the base game of slot and one or more bonus games that become triggered by the slot game. As seen in FIG. 1B, there is room on the cabinet of gaming device 10*b* for an upper display area 32. This area, however, is often not used for gaming purposes and may simply provide a graphic and/or lettering that pertains to a theme of the gaming device.

Video monitors and in particular video-based slot machines are likely going to continue growing in popularity. As the video monitor has been used more and more, however, there has been a growing sentiment that some of the mystique of the old time mechanical gaming devices is lost when mechanical reels and mechanical displays are replaced by a video monitor.

Accordingly, a need exists to provide a gaming device that may use a video monitor, which provides increased flexibility to the gaming device to add more symbols and more elaborate bonus games, while providing some aspect of the gaming device that is mechanical and provides a fun and exciting mechanical display.

SUMMARY OF THE INVENTION

The present invention provides a mechanical display and indication for wagering gaming devices. The present invention includes various embodiments, each of which have a number of common elements. First, the embodiments each include a rotating set of symbol groups or indicia groups. The set includes at least two symbol groups and each symbol group includes a plurality of symbols. The symbol groups or groups of symbols rotate, appear and disappear from the player's view. In this manner, the player sees each of the symbol groups and hopes that the gaming device awards the symbol representing the highest or best value from one of the symbol groups. The rotating symbol groups provide a first random generation. Second, each of the embodiments includes a translating or oscillating indicator such as an arrow. One or more indicators move in a sequence to point out or indicate one of the symbols from one the groups of symbols. The indicators provide a second random generation and a second visual element which produces the final outcome. These random generations can be simultaneous or sequential. The player's attention is thus directed to both random generations including the changing symbol groups and the translating or oscillating indicator.

The gaming devices operable with the present invention include but are not limited to the games of slot, poker, keno, blackjack, bunco and checkers. The display and indicator operates with these base games and/or any bonus game, bonus triggering event, progressive game or any other type of secondary game thereof.

In one preferred embodiment, the display and indicator of the present invention operate with the game of slot and in particular a bonus game of a slot machine. That is, one or more indicators of the present invention point to or indicate an award provided to the player that is in addition to the winnings from the primary slot game. The symbols or indicia indicated by the display can represent any type of award or benefit for the player, such as base game credits, a multiplier of base game credits, a number of picks from a prize pool, a progressive game incrementation, a number of free spins or free games and any combination thereof. The indicia can also signal the player's entry into a bonus game or into a different area of the base game.

For purposes of describing the present invention, the term symbol includes any suitable symbol or images such as numbers of a number of credits, values, letters or words such as the words "Free spin," or playing cards. Each of these types of indicia has or potentially has a value to the player.

In one embodiment of the present invention, the display includes a multisided or multi-surfaced structure rotatable about an axis. For example, in one embodiment the structure is of a prism shape and has three surfaces. It should be appreciated, however, that the structure could be cylindrical and therefore have only one symbol displaying surface. The surfaces each display one of the symbol groups. In another embodiment, multiple structures are provided that move collectively and that each display at least one symbol of the symbol group. A motor or other type of motion control device rotates the structure, so that the symbol groups are sequentially shown and then hidden from the player. In one embodiment, the gaming device rotates each of the symbol groups into the player's view at least once.

One embodiment includes a single indicator that oscillates or translates back and forth to sequentially indicate each of the symbols or symbol positions of the symbol groups. In one embodiment, the indicator includes an arrow. After a period of time, both the rotation of the structure and the oscillation or translation of the indicator stop sequentially or simultaneously, wherein the indicator points to or indicates one of the symbols in one of the symbol groups. The gaming device uses the indicated symbol in a designated manner, such as to provide a number of base game credits to the player, to provide a number of free games or free spins, to provide a number of picks from a prize pool, to indicate the entry into a bonus game, to increment a progressive jackpot and any combination thereof.

In one embodiment, a single motor rotates the structure and translates or oscillates the indicator. One or more mechanical linkages and gears enable the motor to drive the structure and the indicator and to convert rotational motion to translational or oscillating motion. Here, when the motor stops moving, the structure and indicator stop moving simultaneously. Proper gearing enables the structure and indicator to move at desired relative speeds.

In another embodiment, a separate motion control device is used to drive the structure and the indicator. A actuator such as a motor, for example, can be directly or indirectly coupled to a shaft connected to the structure. Another actuator such as a motor can be coupled to one or more mechanical linkages and/or gears that convert the motor's rotational motion to the translational motion of the indicator. When the motors run independently, either the structure or the indicator can stop moving at different times. The structure and indicator can alternatively move at completely different times, e.g., one after the other.

In this primary embodiment, the rotation of the structure provides one random element and the ultimate location of the indicator provides another. Each side or surface of the structure has a symbol group including a plurality of symbols of any average amount desired by the game implementor. One of the sides may have a symbol having a relatively large value adjacent to a symbol having a relatively small value. If this side is ultimately presented to the player, the indicator points to either the large or small valued symbol, one of which is ultimately provided to the player. Other sides can have a plurality of medium valued symbols. Other sides can have mixed symbols, e.g., mixed credits or multipliers, mixed credits and free spins, mixed credits and picks from a prize pool, etc.

Another primary embodiment of the present invention includes multiple translating indicators. Here, instead of a single indicator translating or oscillating back and forth, sequentially pointing to different symbols or symbol positions, each indicator moves towards or away from a single associated symbol position of each of the groups. In one preferred embodiment, only one indicator is close to its symbol, i.e., indicating the symbol, at a given time. Other indicators may at the same time be in the process of moving towards their respective symbol positions. Still other indicators are fully moved away from their respective symbol positions. When the structure stops rotating and the indicators or arrows stop translating, the gaming device awards the player with the value of the symbol of the indicator closest to its associated symbol. The award can be any of those described above. In one such embodiment, a motor is coupled to a lead screw which drives a cam to oscillate the indicator. As the motor spins, the cam translates along the lead screw. The cam has a shape, such as a triangular shape that pushes one or more of the indicators towards the associated symbol position. The indicator currently located at the tip of the cam is the one that is currently closest to and therefore indicating its associated symbol position. The symbols in the symbol positions change due to the rotation of the structure. The indicators are spring loaded and return to their "non-indicating" position once the cam passes by.

Additional features and advantages of the present invention are described in, and will be apparent from, the following Detailed Description of the Invention and the figures.

DETAILED DESCRIPTION OF THE INVENTION

The present invention provides a display and display indicators that operate with a multitude of primary or base wagering games, including but not limited to the games of slot, poker, keno, blackjack, bunco and checkers. In an embodiment, the display and indicators operate in conjunction with secondary or bonus games, which in turn operate in conjunction with the above listed primary games. Besides such base and bonus games, the present invention can operate with any of the bonus triggering events, as well as any progressive game coordinating with these base games. The symbols and indicia used for any of the primary or base games, bonus or secondary games or progressive games include any suitable symbols, images or indicia.

Figure 1A:
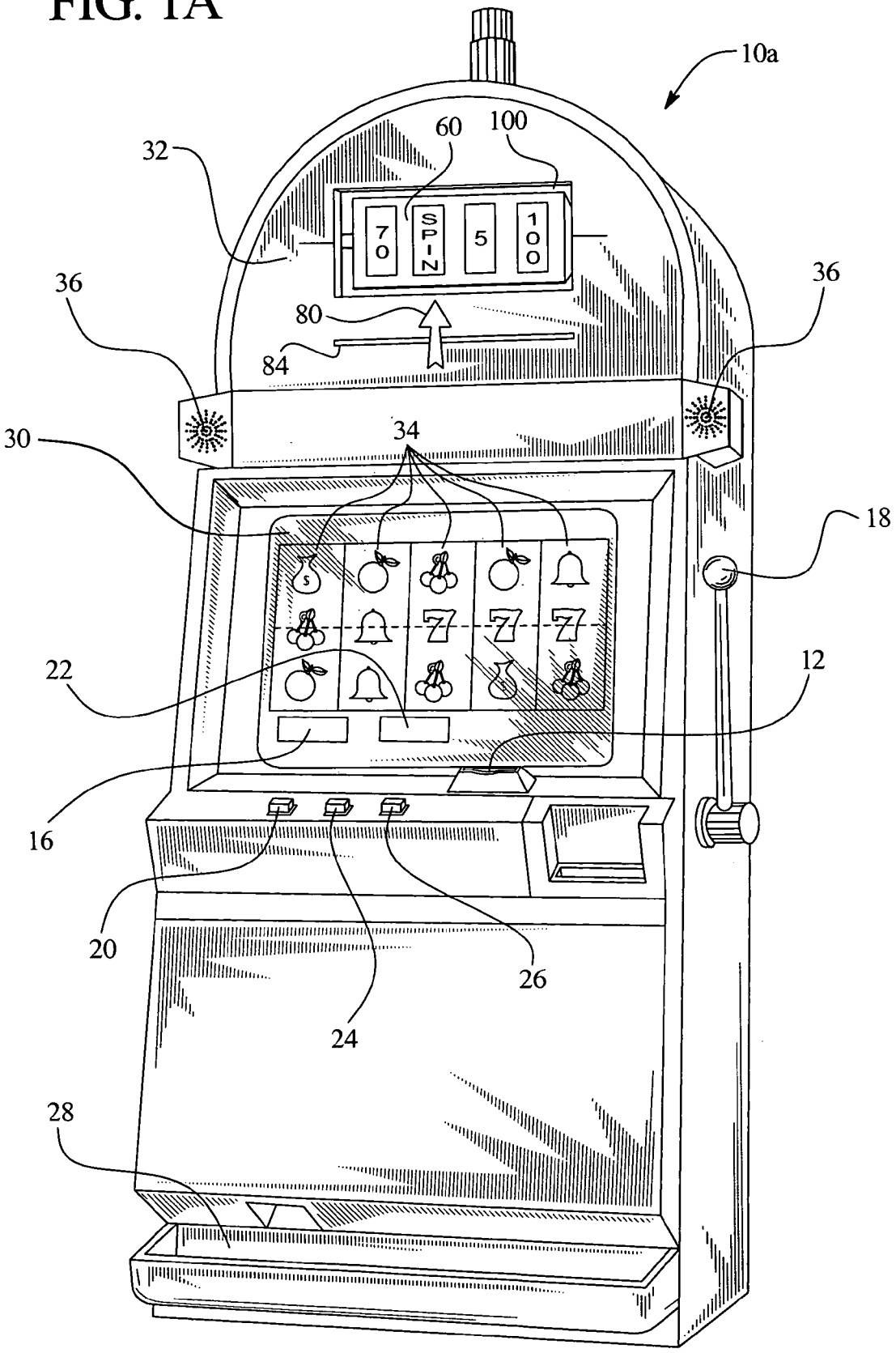
FIGS. 1A and 1B are perspective views of alternative embodiments of the gaming device of the present invention.
Figure 1B:
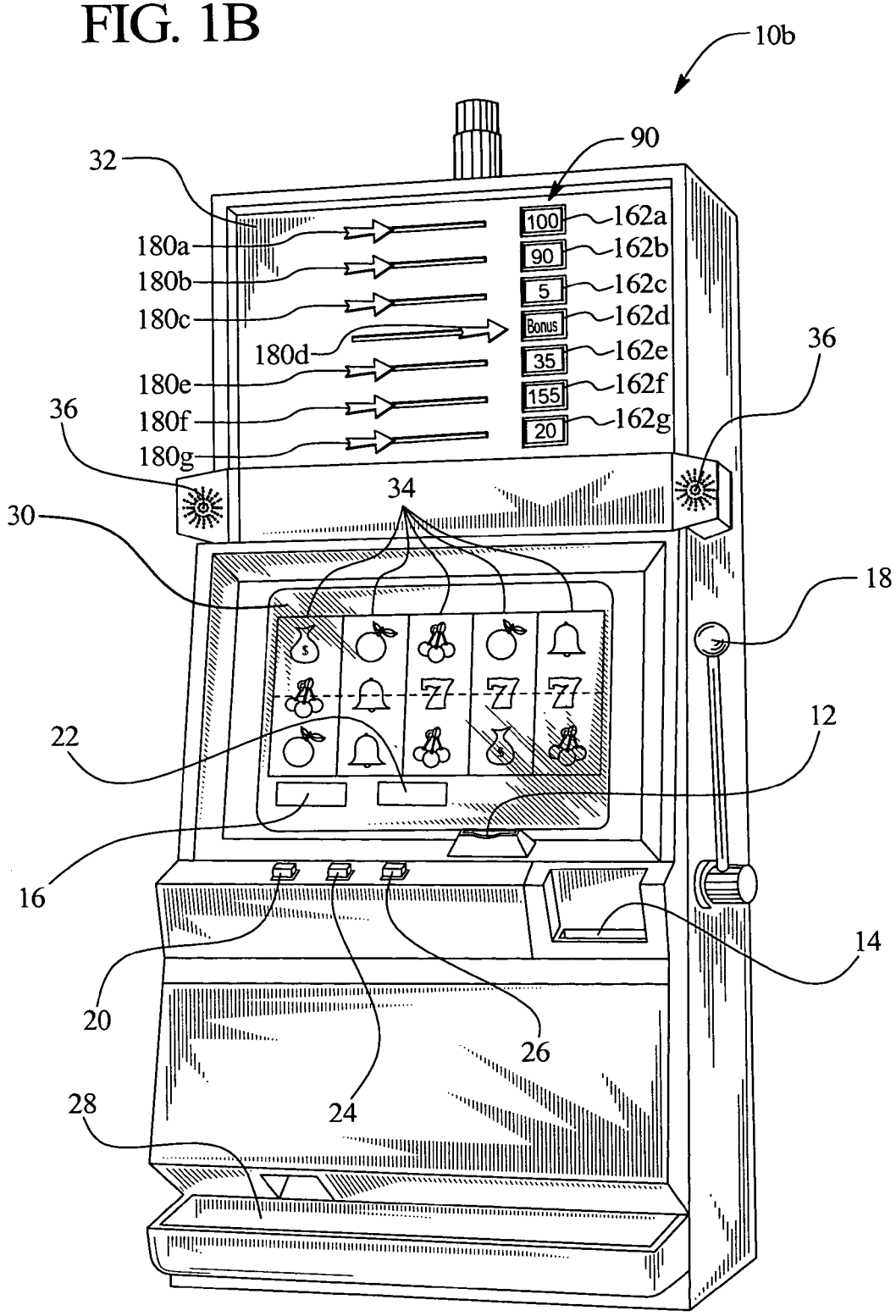

One primary embodiment for the display and display indicators is with a slot game. Referring now to the drawings, and in particular to FIGS. 1A and 1B, one slot machine embodiment is illustrated. Gaming devices 10*a* and 10*b* illustrate two possible cabinet styles and display arrangements and are collectively referred to herein as gaming device 10. Gaming device 10 is illustrated as having the controls, displays and features of a conventional slot machine, wherein the player operates the gaming device while standing or sitting. Gaming device 10 also includes being a pub-style or table-top game (not shown), which a player operates while sitting.

Gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. A player may cash out by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiments shown in FIGS. 1A and 1B include a display device 30 and a cabinet having an upper display area 32. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The display and display indication of the present invention is provided, in an embodiment, in the area of the upper display area the cabinets of gaming devices 10*a* and 10*b* of FIGS. 1A and 1B. The display and display indication of the present invention is provided, in another embodiment, on top of the rounded cabinet of gaming device 10*a* or rectangular cabinet of gaming device 10*b*. In a further embodiment, the top portion or top box of the gaming device is removed, creating a lower profile machine. Here, the display and display indication of the present invention sits on top of gaming device 10 but is lower to the ground than if the top box is not removed.

The slot machine embodiment of gaming device 10 includes a plurality of reels 34, for example three to five reels 34. Each reel 34 includes a plurality of indicia such as bells, hearts, fruits, numbers, letters, bars or other images which correspond to a theme associated with the gaming device 10. If the reels 34 are in video form, the display device displaying the video reels 34 is, in one embodiment, a video monitor. Gaming device 10 includes speakers 36 for making sounds or playing music.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 employs a video-based display device 30 for the bonus games. The bonus games include a program that automatically begins when the player achieves a qualifying condition in the base game.

Figure 2:
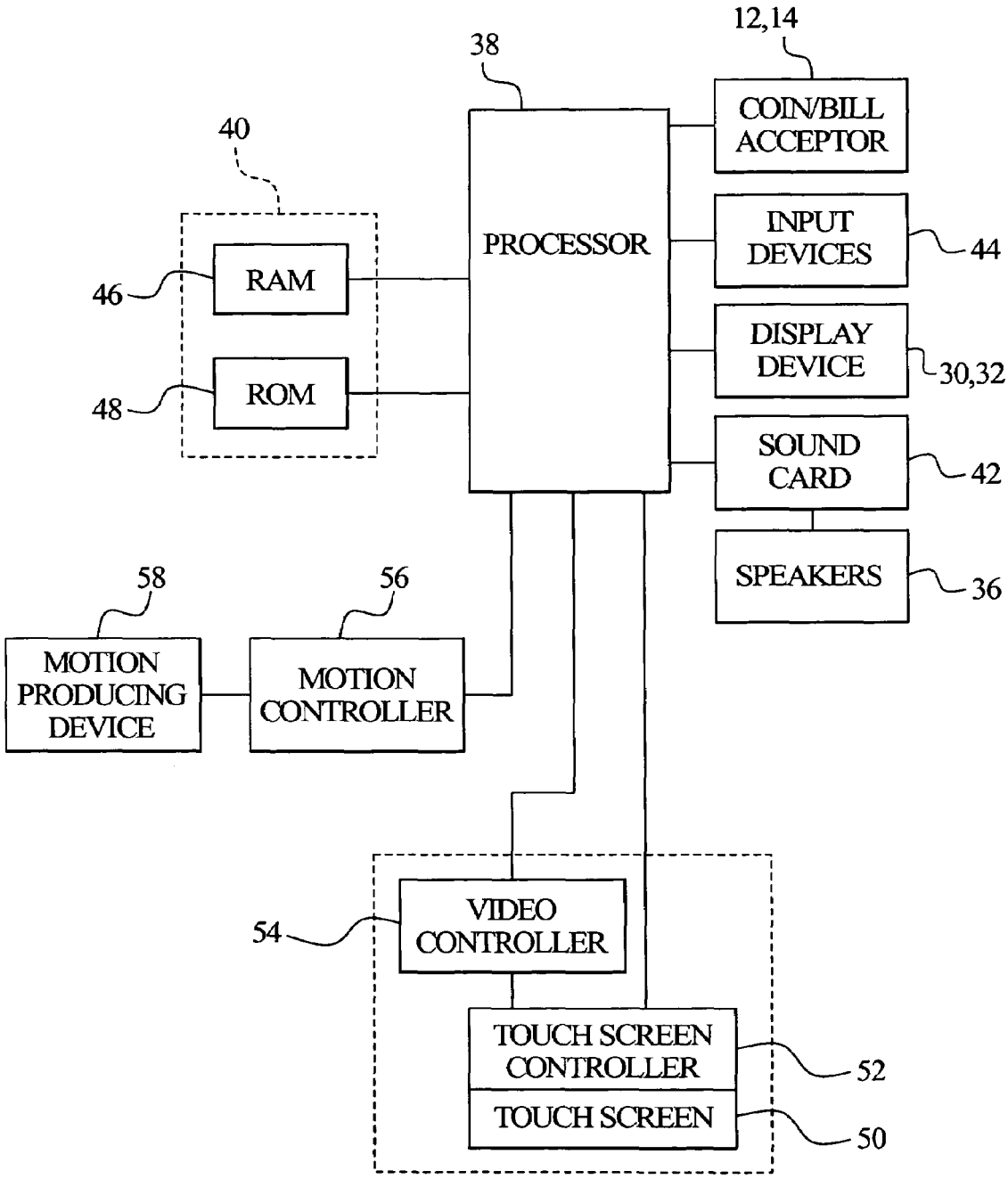
FIG. 2 is a schematic block diagram of the electronic configuration of one embodiment of the gaming device of the present invention.

Referring now to FIG. 2, one embodiment of an electronic configuration for gaming device 10 includes: a processor 38; a memory device 40 for storing program code or other data; a display device 30; a sound card 42; a plurality of speakers 36; and one or more input devices 44. The processor 38 is a microprocessor based platform that is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player uses the input devices 44 to input signals into gaming device 10. In the slot machine base game, the input devices 44 include the pull arm 18, play button 20, the bet one button 24, the cash out button 26 and other player inputs. A touch screen 50 and touch screen controller 52 are connected to a video controller 54 and processor 38. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money to start the game.

The processor 38 also controls the output of one of more motion controllers 56 that control one or more motion producing devices 58. The motion producing devices 58 can be any combination of motors, stepper motors, linear stepper motors or other types of linear actuators. The motion controllers 56 typically include printed circuit boards or stand alone enclosures that receive high level commands from the processor 38. The motion controller 56 converts the high level commands, for example, into a number of step pulses, which in turn are converted into motor currents. The stepper motor or other type of motion producing device 58 receives the currents, wherein the currents cause, for example, a rotor to turn within a stator a precise and desired amount.

As described more fully below, the rotational motion of a motor 58 can be used to rotate a portion of the display or indicator of the present invention. The rotational motion can alternatively be converted to cause a portion of the display or indicator to translate. Otherwise, a linear motion producing device 58 can be used to directly cause a portion of the display or indicator of the present invention to translate.

The motion control scheme facilitates complex movements of multiple parts to be programmed into the memory device 40 and carried out by the processor 38 at the appropriate time in the sequence of the game, be it a base, bonus, bonus triggering or progressive sequence of gaming device 10. Moreover, multiple programs can be implemented in the memory device 40, wherein the processor runs the appropriate program at the appropriate time, and wherein the displays and indicators described below can perform or move differently, e.g., faster slower or in different directions at different times or points in the game. The motion control programs, in an embodiment, interface with one or more random generation devices, typically software based items, to produce randomly displayed outcomes on the displays and indicators of the present invention.

Figure 3A:
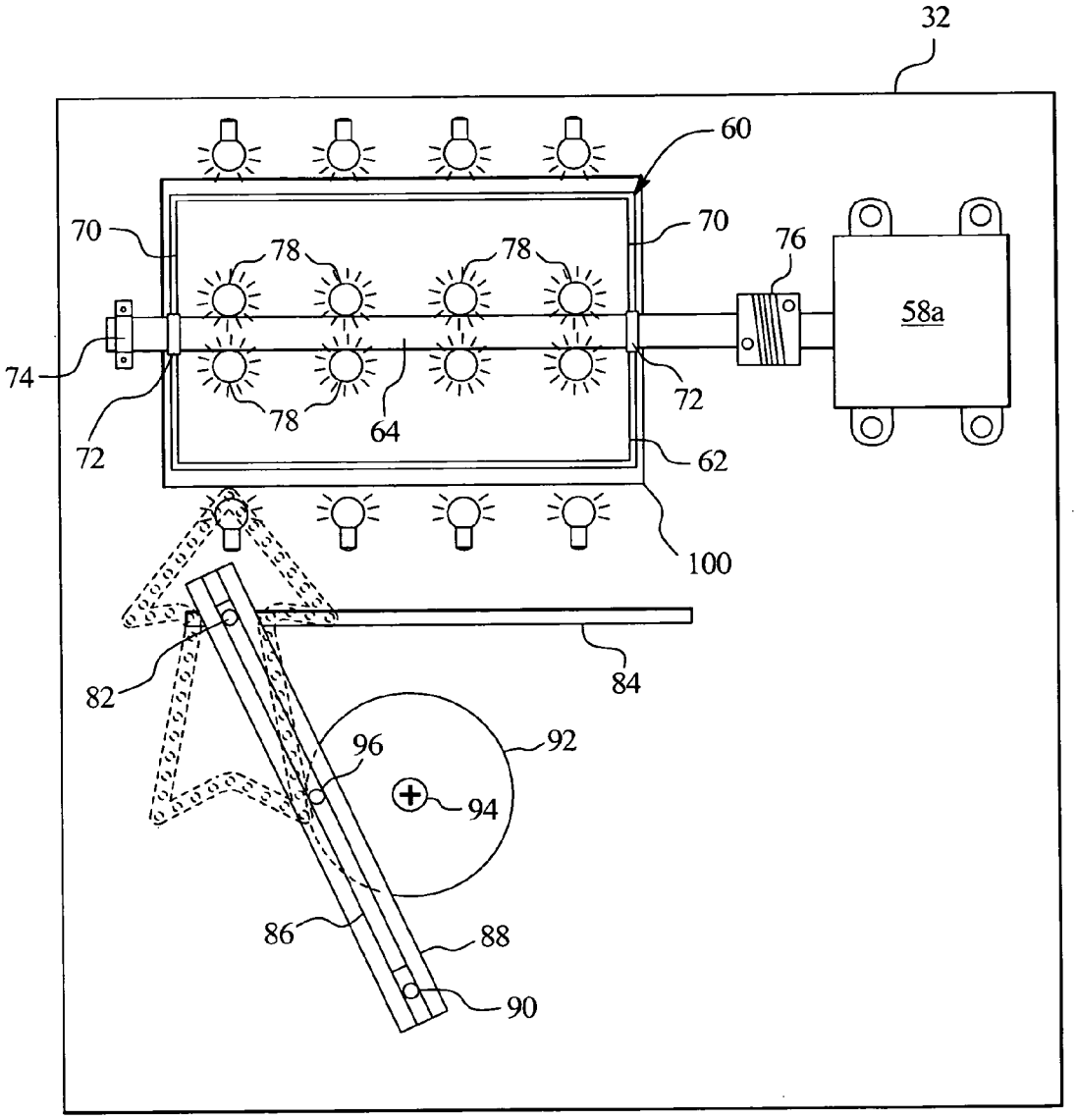
FIGS. 3A and 3B are rear elevation and side elevation views of one embodiment of the rotating display and translating indicator of the present invention.
Figure 3B:
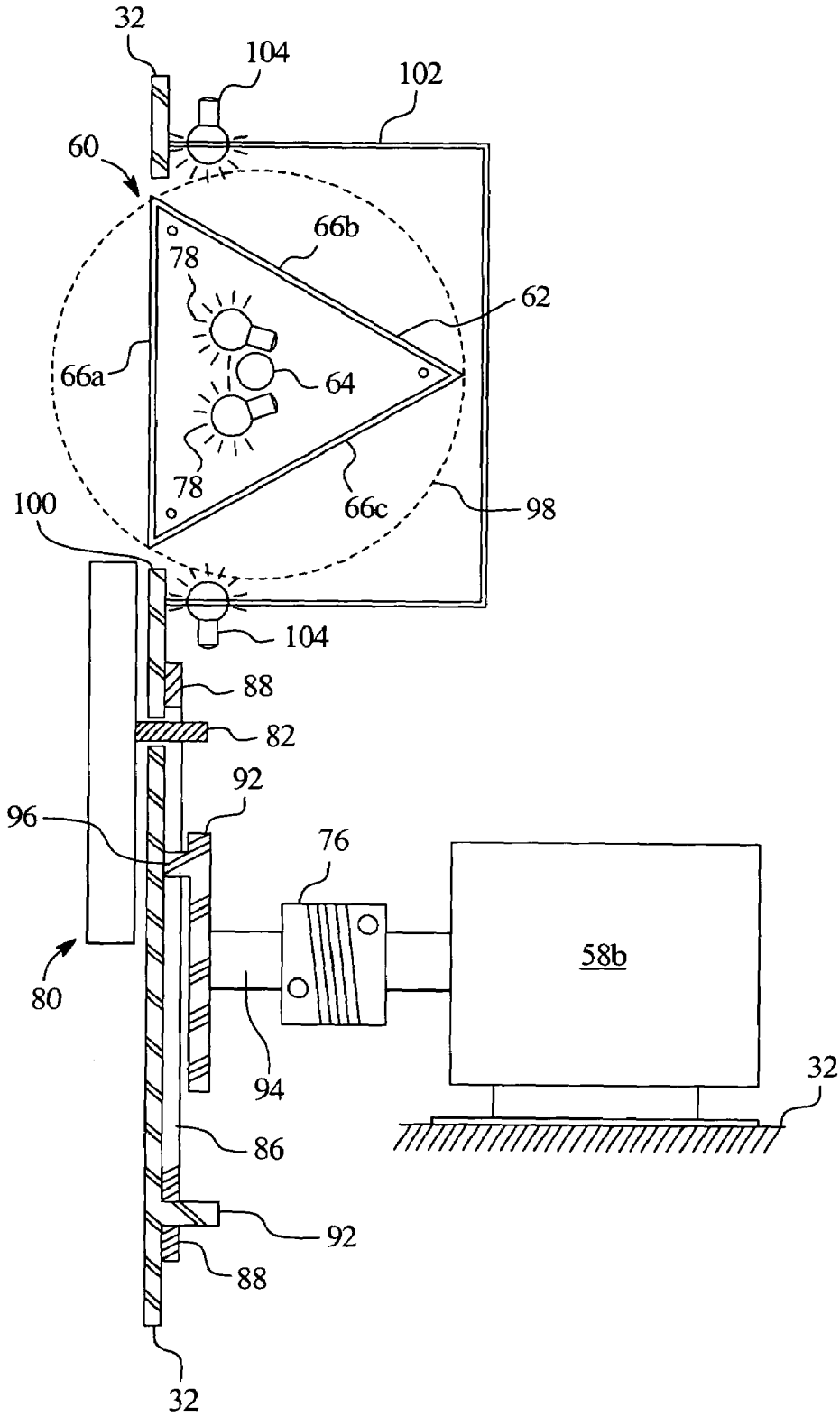

Referring now to FIGS. 3A and 3B, various elevation views of one primary embodiment of the present invention are illustrated. The present invention is illustrated as being part of the upper display area 32 of the cabinet of gaming devices 10*a* and 10*b* of FIGS. 1A and 1B. While this is one possible arrangement for the present invention, this primary embodiment could alternatively be mounted on top of a cabinet of gaming device 10 or placed at some other area of the panel of gaming device 10. Further, the top box could be removed and the present embodiment mounted in place of same to create a lower profile machine.

This primary embodiment includes a display 60 and an indicator 80. The display 60 includes a structure 62. The structure 62 in the illustrated embodiment has three unitary sides or surfaces 66*a* to 66*c*. The structure 62 can alternatively have any suitable and feasible number of sides or surfaces. Alternatively, the structure 62 can be cylindrical and therefore have only one side or surface, which as illustrated below, displays symbols to the player. In one preferred embodiment of the present invention, each side of the structure is formed from a rectangular frame with spaced-apart cross bars (not shown) and a plurality of removable and replaceable inserts (not shown) positioned or mounted in the frame. Each insert includes a symbol on its exterior surface.

The structure 62 rotates about an axis along an axle or shaft 64. In one embodiment, the sides or surfaces 66*a* to 66*c* are attached to end walls 70. The end walls 70 define apertures or include couplers 72 that enable the shaft or axis 64 to be attached to the structure 62. In this manner, when the shaft 64 moves or rotates, the structure 62 moves or rotates the same amount. In an alternative embodiment, the structure rotates relative to the shaft through suitable coupling members (not shown) such as gears. In this embodiment when the shaft turns the structure rotates. In a further preferred embodiment, the structure rotates on bearings (not shown) relative to shaft, axle or axis. This enables the illumination devices such as lights to be mounted to the shaft or axle. In this embodiment another mechanism causes the structure to rotate relative to the shaft. In a preferred embodiment, the shaft is hollow to provide for the wiring of the illumination devices.

The materials for the structure 62 and shaft 64 can be metal, plastic, wood and any combination of these. If the shaft 64 and structure 62, or at least the end walls 70 of 62 are metal, the shaft 64 can be welded directly to the end walls 70. Otherwise, the couplings 72 allow for dissimilar materials, such as a plastic structure 62 with plastic side walls 70 and a metal, e.g., steel shaft.

In the illustrated embodiment, the shaft 64 is mounted inside a bearing 74 on one end and is attached to a motor coupler 76 at its opposite end. The bearing 74 is mounted to the upper display area 32 of the cabinet, including some structural member thereof, via mounting holes in the bearing 74 and bolts as is well known in the art. The shaft 64 is connected or coupled to a motor 58*a* via the motor coupler 76. The motor coupler 76 can include a spring portion that compensates for a slight misalignment between the shaft of the motor 58*a* and the axis or shaft 64. The motor 58*a* is mounted to the upper display area 32 of the cabinet, including a structural member thereof, via mounting holes and bolts as is well known in the art.

The motor 58*a* in an embodiment is a stepper motor. The motor 58*a* is one possible type of motion control device 58 illustrated in FIG. 2. As illustrated in FIG. 2, the motor, e.g., stepper motor 58*a*, is connected via one or more electrical cables to a motion controller 56. The motion controller 56 communicates with the processor 38. The processor 38 runs a program stored in the memory device 40, which enables the processor 38 to send high level commands to the motion controller 56. The motion controller 56 in turn outputs motor currents to the stepper motor 58*a* to precisely control the motion and speed of same.

It is well known in the art of stepper motors, to run a program that controls precisely the acceleration, velocity and duration or distance that the shaft 64 moves. Stepper motor 58*a* can therefore cause the structure 62, which in this case includes three sides 66*a* to 66*c*, to rotate either clockwise or counterclockwise and to have any desired sequence of movement. Structure 62 can rotate, dwell and rotate in the opposite or the same direction, etc. Although the stepper motor 58*a* is one preferred embodiment of the motion control device 58, other devices may be used, such as linear stepper motors, servo motors, direct current ("DC") motors and other types of linear actuators.

The display 60 in an embodiment includes one or more light sources 78 placed inside the sides or surfaces 66*a* to 66*c* of the structure 62 as discussed above. In one preferred embodiment, the light sources are attached to the shaft which does not move. The interior light sources 78 provide backlighting for the symbols shown later that appear on the sides or surfaces 66*a* to 66*c*. Light sources 78 can emit white light or any desired color of lighting.

The indicator 80 is illustrated in phantom because in the view of the back of the upper display area 32 depicted in FIG. 3A, indicator 80 exists or resides on the front side of the area 32 and therefore would not be seen from the inside of gaming device 10. The indicator 80 includes or is attached to a shaft 82. The shaft 82 and therefore the indicator 80 translates or oscillates horizontally within a groove 84 defined by a panel of the upper display area 32 of the cabinet. The groove 84 defines the motion of the indicator 80. The groove 84 is sized appropriately to snuggly allow the shaft 82 to protrude from the front of the upper display area 32 through the thickness of the panel and into the interior gaming device 10. The front of the upper display area 32 may also include a guide type structure to prevent the indicator 80 and the shaft 82 from rotating slightly as the indicator 80 and shaft 82 translate back and forth within the groove 84. That is, it is desirable that the indicator 80 appear to have a smooth motion as it moves back and forth horizontally, adjacently to one of the surfaces of the structure 62.

The indicator 80 as illustrated is in one embodiment includes an arrow. The arrow is a well known shape that tends to direct the attention of a player or viewer towards the head of the arrow. It should be appreciated, however, that the indicator can take any suitable desired shape. Furthermore, the arrow itself can have many different desired shapes. The indicator 80 can alternatively be a needle, a teardrop, an appendage of a person or animal, the hand of a clock or any other type of desired structure.

The shaft 82 protruding inside of the cabinet gaming device 10 through the panel of the upper display area 32 from the indicator 80 extends inside of a slot 86 defined by a lever arm 88. The slot 86, in the same manner as the groove 84, is sized to snuggly allow the shaft 82 to extend therethrough. The lever arm 88 pivots at one end about pivot 90. Pivot 90 is attached to the inner wall of the upper display area 32 or to a structural member thereof. The lever arm 88 pivotally moves about the pivot 90.

A wheel 92 rotates about an axis or shaft 94 which is attached to the wheel 92. The shaft 94 is coupled via a motor coupler 76, which in an embodiment has a spring portion to compensate for slight misalignments between the motor 58*b* and shaft 94 of the wheel 92. The motor 58*b* can again be other suitable types of motion control devices 58 described above, but is in one preferred embodiment a rotating stepper motor. The stepper motor 58*b* is controllable as described above with respect to the stepper motor 58*a*. The stepper motor 58*b* is mounted to a structural member of the upper display area 32 of the cabinet.

The wheel 92 driven by the shaft 94 and the motion control device 58*b* in turn drives a pin 96. The pin 96 can be integral to or connected to the wheel 92 via any suitable mechanism or method. As the shaft 94 and wheel 92 rotate, the pin 96 strikes a circular arc around the shaft 94 at the radius of the pin 96 to the center of the wheel and shaft. The pin 96 protrudes through and sits inside of the slot 86 as does the shaft 82 of the indicator 80.

When the shaft 94 and wheel 92 rotate, the circumferential movement of the pin 96 causes the lever arm 88 to pivot back and forth about the pivot 90. While the pin 96 and the shaft 82 move translationally within the slot 86 of the lever arm 88, the lever arm 88 remains translationally fixed with respect to the pivot 90. Movement of the lever arm 88 causes the shaft 82 and the indicator 80 to move translationally within the groove 84 in the panel of the upper display area 32 of the cabinet.

By precisely controlling the rotational motion of the shaft 94 and wheel 92, the stepper motor 58*b* precisely controls the position, velocity and acceleration of the indicator 80 along its movements back and forth with respect to the groove 84. In this manner, the indicator 80 can pinpoint or point to any desired area along one of the sides or surfaces 66*a* to 66*c* at a given point in time.

As illustrated in FIG. 3B, the triangular structure 62 strikes an arc marked by the phantom line 98. It should therefore be appreciated that at various times, the corners of the triangular structure 62 extend out from the upper display area 32 marked in FIG. 3B by the cross sectioned panel 32. (certain elements in FIG. 3B are shown in cross section for clarity). The panel of the upper display area of 32 defines an opening 100, which enables the player to view the sides or surfaces 66*a* to 66*c* of the structure 62.

Gaming device 10 in one embodiment provides a cover 102, which shields and protects the inside of game device 10 from any type of foreign object entering gaming device 10 from the opening 100. The cover 102 also traps and concentrates light from light sources 104 mounted exterior to the structure 62. One or more of the sides or surfaces 66*a* to 66*c* can be reflective or have reflective portions, which reflect light from the exterior light sources 104. As indicated above, the cover 102, panel of upper area 32, lever arm 88, wheel 92, shaft 94, pin 96, shaft 82 can be made of various suitable materials such as metal, plastic, wood and combinations thereof. The sides 66*a* to 66*c* of the structure 62 can have one or more openings that allow interior light sources 78 to shine through to the outside of gaming device 10. Further, sides or surfaces 66*a* to 66*c* can have any combination of digital images and silk-screened images that can selectively allow light to shine through or alternatively illuminate portions of the structure 62 of the display 60.

Figure 4:
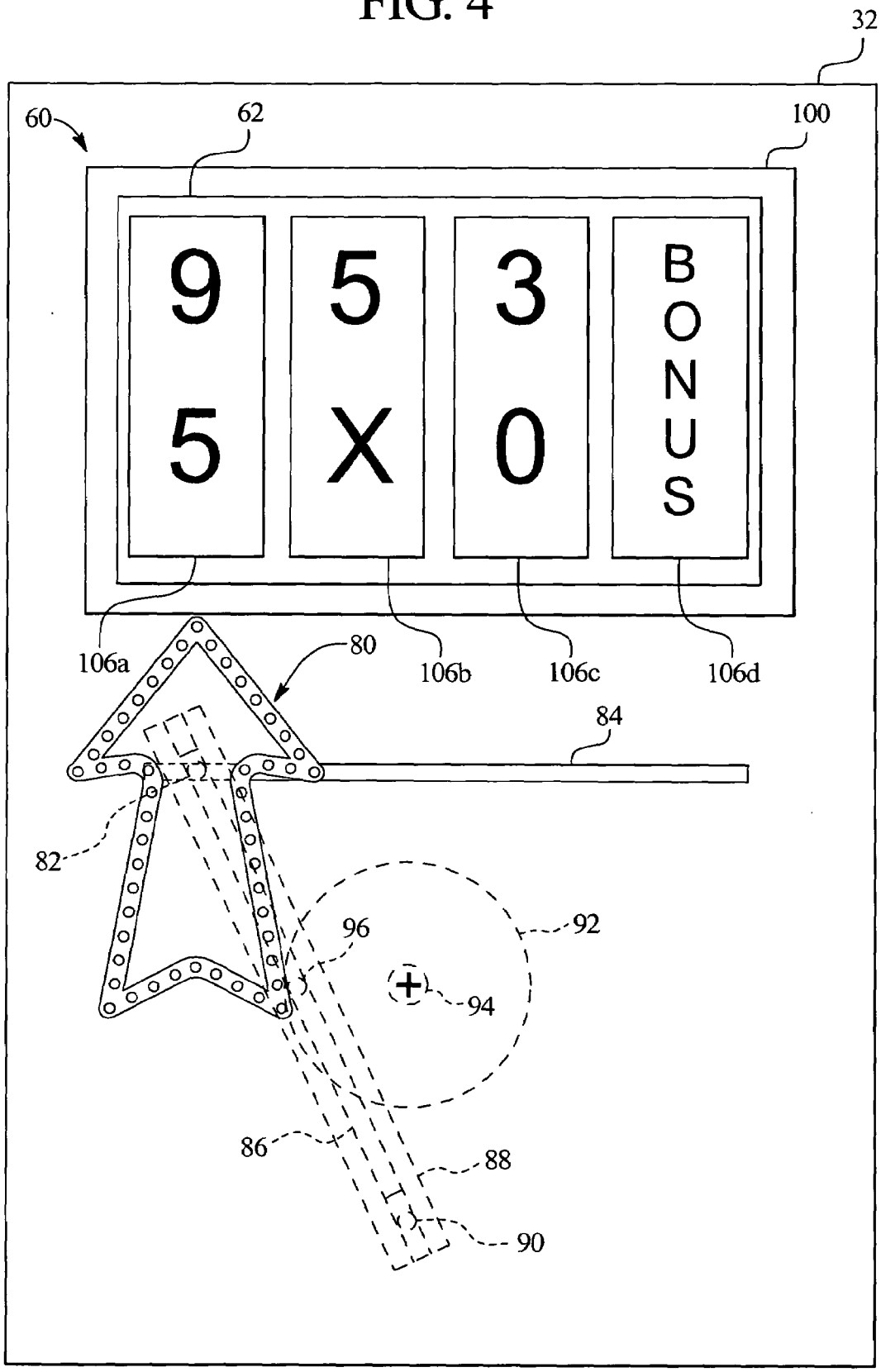
FIG. 4 is a front elevation view of the rotating display and indicator illustrated in FIGS. 3A and 3B.

Referring now to FIG. 4, a view of the display 60 and indicator 80 from the front of the upper display area 32 of the cabinet of gaming device 10 as illustrated. As illustrated with respect to FIGS. 3A and 3B, the display 60 includes an opening 100 within the panel of the upper display area 32 and the cylindrical or multisided structure 62. The indicator 80 is connected integrally or directly to a shaft 82. The shaft 82 extends through a groove 84 defined by the panel of the upper display area 32. The shaft 82 also extends into a slot 86 defined by a lever arm 88.

The lever arm 88 pivots about a pivot 90 which is connected to the panel of the upper display device 32 or to a structural member thereof. The stepper motor 58*b* (FIG. 3B) drives the shaft 94, which turns the wheel 92 and rotates the pin 96 about the shaft 94. The pin 96 pivots the lever arm 88 back and forth about pivot 90 as the pin 96 circumferentially rotates about the shaft 94. The shaft 82 translates back and forth with slot 86 as well as groove 84. As the shaft 82 translates, the indicator 80 translates likewise along the bottom of the structure 62 of display 60.

The one or more sides 66*a* to 66*c* of the structure 62 each include and display a group of symbols, such as the group including symbol 106*a* to 106*d* on one of the sides. Symbols 106*a* to 106*d* move together as a group. As illustrated, symbols 106*a* and 106*c* are numbers. These numbers can represent a number of base game credits, e.g., a number of slot machine credits, a number of picks from a prize pool, a number of increments of a progressive game, etc. The number 106*b* is a multiplier and designates a multiplier number and the letter "X", signifying the function of multiplication. The symbol 106*d* designates that the player will enter a bonus round or receive some type of bonus award. The symbols of the present invention can therefore represent many different types of benefits to the player.

The primary embodiment illustrated FIGS. 3A, 3B and 4 includes two independent random elements or generations. The first independent random generation determines which side or surface 66*a* to 66*d*, i.e., which symbol group, is ultimately presented to the player. Even if the structure 62 is cylindrical, different portions of the cylinder have different sets or groups of symbols, such as the symbols 106*a* to 106*d*, wherein the cylindrical structure is rotated so that the player can see the different sets of symbols at least one set at a time. The second independent random generation of this primary embodiment determines which symbol of the symbol group designated by the first random generation is ultimately provided to the player, i.e., which symbol of the generated group does the indicator 80 indicate. The random generations are preferably simultaneously activated, but could also be sequentially activated. For example, depending upon the benefit of the bonus symbol 106*d* and the amount of base game credits multiplied by multiplier 106*b*, the player may desire either of these symbols or to have the ninety-five credits provided by the symbol 106*a*. Certainly, the player would rather have the ninety-five credits of symbol 106*a* versus the thirty-credits of symbol 106*c*.

FIGS. 3A and 3B illustrate that the display 60 and the indicator 80 are controlled independently by separate motors 58*a*and 58*b*, respectively. In an alternative embodiment (not illustrated), a mechanical linkage and a set of gears can be used to couple a single motor to both the display 60 and the indicator 80. One example of this is illustrated below with respect to FIG. 8.

Providing separate stepper motors 58*a* and 58*b* enables the display 60 and the indicator 80 to be controlled independently. For example, a sequence could begin in which the display 60 begins to rotate about the axis or shaft 64, so that the sides or surfaces 66*a* to 66*c* are each displayed to the player at least one time. The player therefore sees each of the possible symbols, such as symbols 106*a* to 106*d*. The structure 62 rotates at a speed slow enough so that the player can discern the different symbols. The structure 62 can rotate in one direction stop and then rotate in another direction as desired by the game implementor. After a period of time, the indicator 80 can begin to translate back and forth while the structure 62 continues to rotate. The player watches the symbol groups come into and out of view and the indicator

80 indicate different areas of the structure 62 of the display 60. The structure 62 in an embodiment stops and displays one of the sides or surfaces 66*a* to 66*d*, while the indicator 80 continues to translate back and forth across the opening 100 of the display 60. Here, the player sees the potential symbol groups, such as symbols 106*a* through 106*d* in one symbol group, but does not know which symbol the indicator 80 will ultimately indicate. Finally, the indicator 80 stops and indicates or points to the symbol in the symbol group that is provided to the player. In one preferred embodiment of the present invention, upon the occurrence of a triggering event, such as a symbol or symbol combination occurring in a primary game, the structure begins to rotate to sequentially display the different. symbol groups and the indicator begins to oscillate to sequentially indicate each of symbol positions of the symbol groups. In one preferred embodiment, the structure stops rotating and displays one of the symbol groups and then the arrow or indicator stops moving to indicate one of the symbols of the displayed symbol group. The player is provided with the outcome, if any, based on the symbol. The outcome could be for instance credits, free games, modifiers such as multipliers.

As stated above, the symbol can have many outcomes depending upon how the symbol and associated display is integrated into gaming device 10. The processor 38 knows which symbol is indicated so that gaming device 10 can provide the proper amount of credits, multipliers, progressive game increments, etc., to the player. In an embodiment gaming device 10 uses an open loop system in which the processor 38 assumes that the display 60 and indicator 80 proceed to the position that they are told to move. That is, one or more random generation devices within the software of gaming device 10 decides beforehand which symbol to provide to the player. Gaming device 10 then executes a motion control program to achieve the result and at the same time provide a random display to the player. The stepper motor is highly accurate and in one embodiment, gaming device 10 relies on the fact that the structure 62 and the indicator 80 rotate and pivot respectively to the commanded position.

In one alternative embodiment, gaming device 10 uses positional, e.g. rotational positional, feedback to ensure that the structure 62 and the indicator 80 rotate and pivot respectively to the proper place. In the case of a stepper motor, gaming device 10 knows how many steps or pulses it has told the motor to rotate. A positional feedback device, such as an encoder, is positioned on the back of the motor to count a number of positional markers that the motor has rotated. The positional markers enable the processor 38 to calculate where the motor shaft is in relation to a marker. For example, if the pin 96 is used as a marker, the processor 38 knows that when the motor shaft is at the zero position, the pin 96 is at twelve o'clock on the wheel 92, and that the indicator 80 is positioned in the middle of the display 60. The structure 62 can alternatively include a pin or other type of extension that rotates past a sensor, for example a magnetic sensor, which senses that the structure 62 is at a particular position. When the sensor senses this pulse, it sends an electrical signal to the processor 38, so that the processor 38 knows exactly within one rotation of the structure 62 where the structure is.

Figure 5:
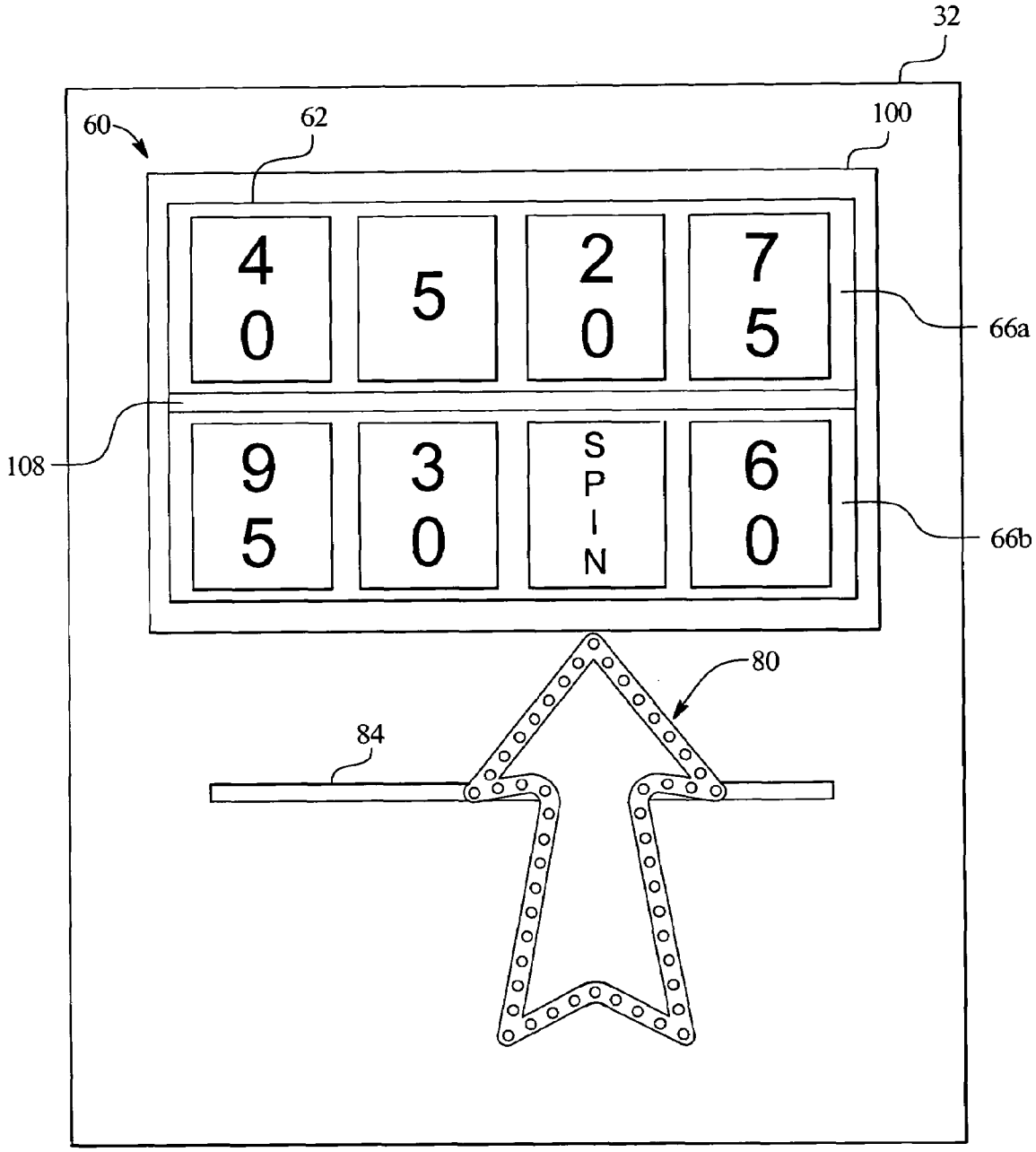
FIG. 5 is another front elevation view of the rotating display and indicator illustrated in FIGS. 3A, 3B and 4.

Referring now to FIG. 5, the structure 62 has rotated so that some or all of two sides or surfaces 66*a* and 66*b* are visible to the player. An edge 108 exists between the surfaces 66*a* and 66*b*. A portion of the surfaces 66*a* and 66*b* and the edge 108 between same extend slightly outside of the opening 100 defined by the panel of the upper display area 32. As described above, the display 60 includes a cover 102 (inside gaming device 10) that protects the interior of the gaming device from foreign objects that enter the through the opening 100 around the sides or surfaces 66*a* and 66*b*. It should be appreciated that the display as illustrated in FIG. 5 could be rotating up towards the top of the opening 100 or down towards the bottom of the opening 100 in either rotational direction. As also illustrated, the groove 84 can be made very narrow and almost invisible to the player, so that the indicator 80 appears to be floating outside of gaming device 10.

Figure 6:
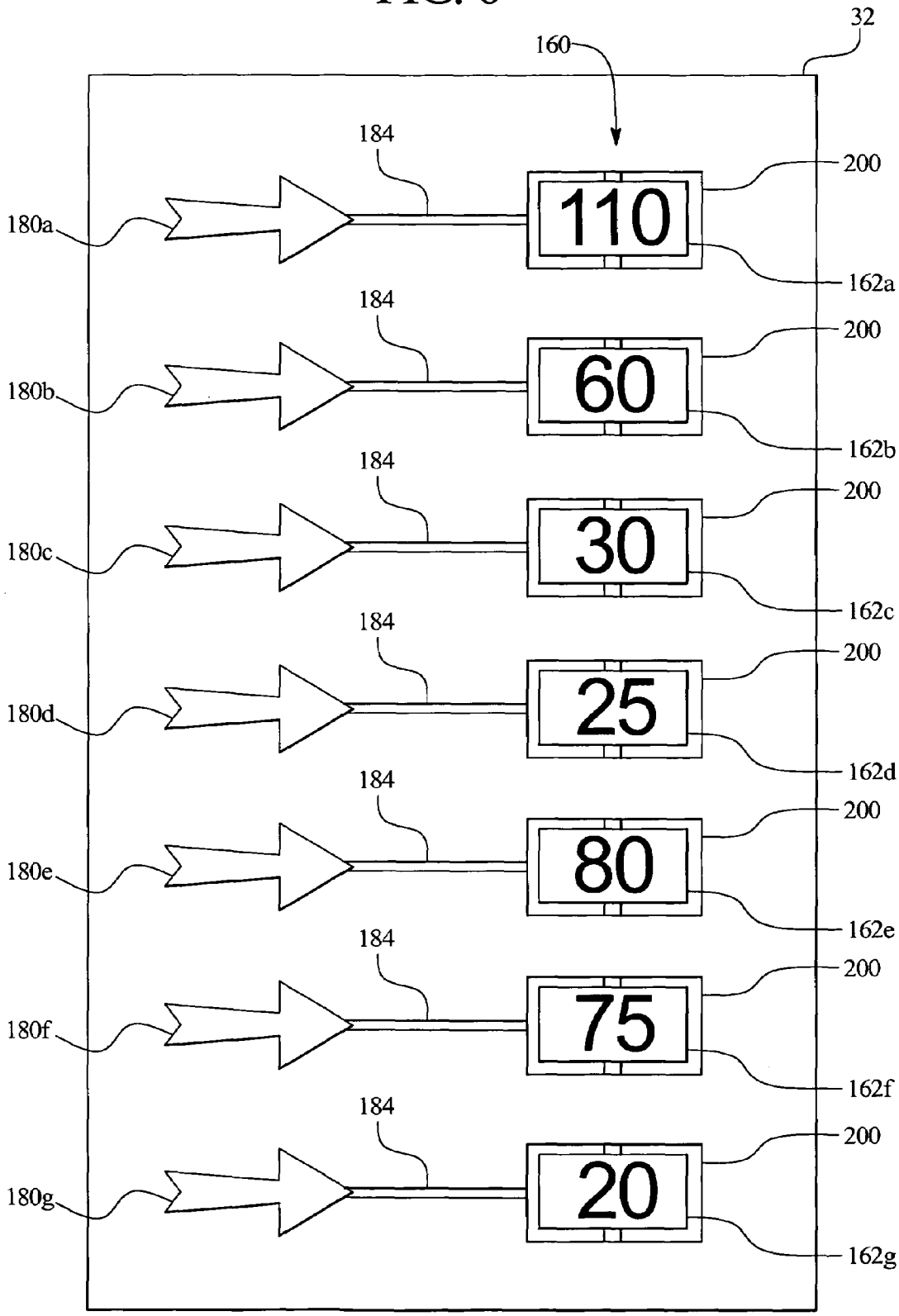
FIG. 6 is a front elevation view of another embodiment of the present invention having a rotating display and multiple translating indicators of the present invention.
Figure 7:
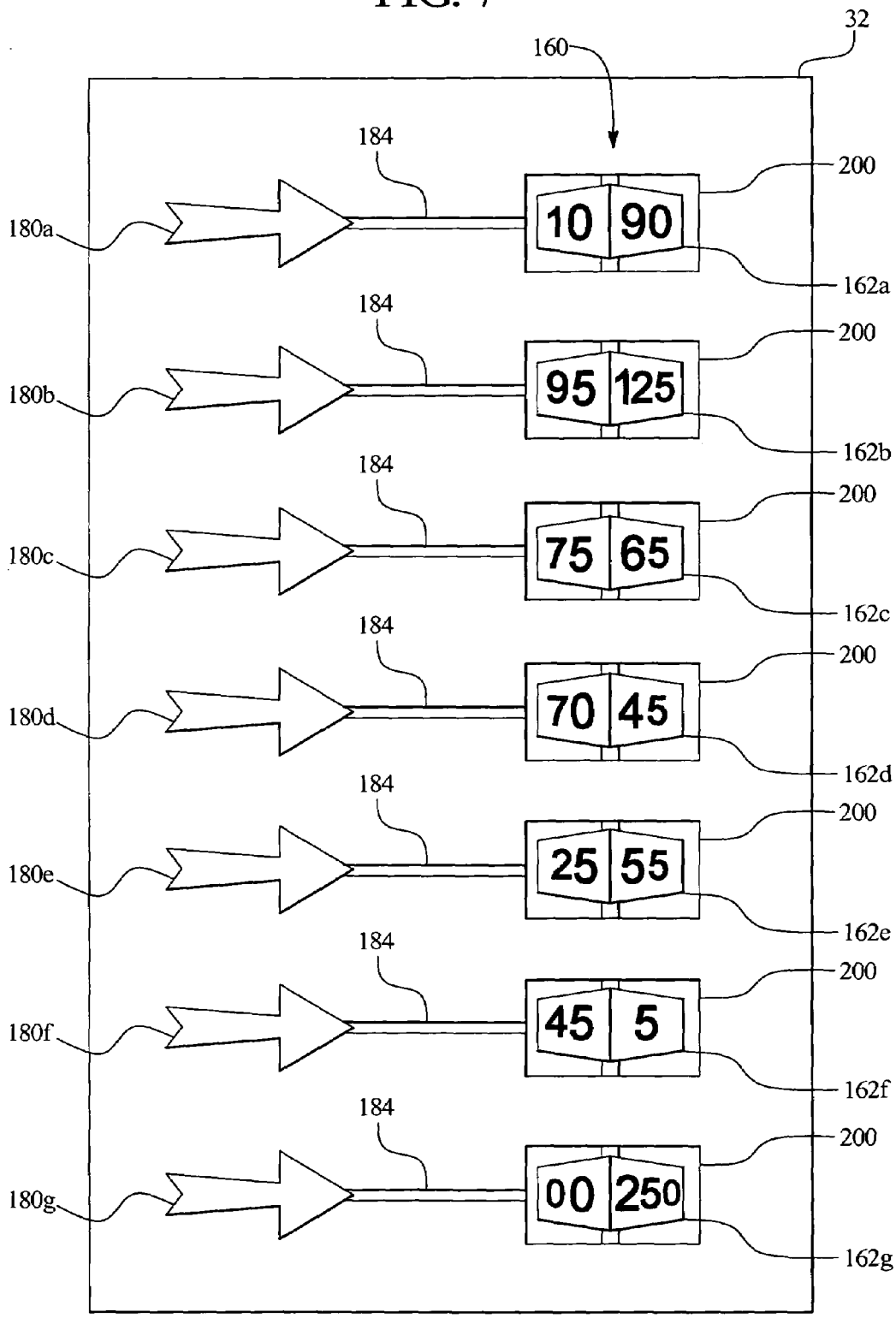
FIG. 7 is another front elevation view of the embodiment of the present illustrated in FIG. 6.
Figure 8:
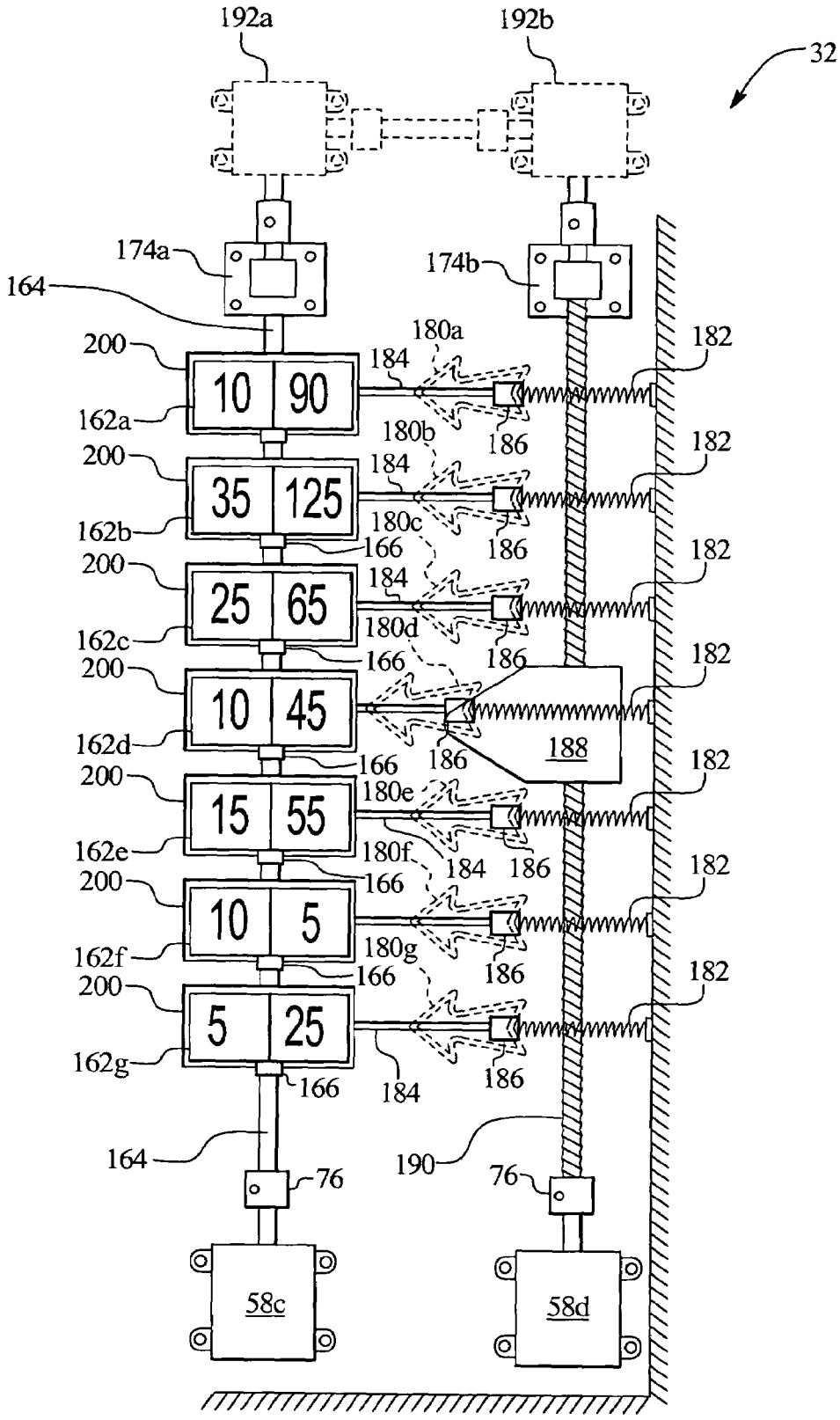
FIG. 8 is a rear elevation view of the embodiment of the present illustrated in FIGS. 6 and 7.

FIGS. 6 to 8 illustrate a second primary embodiment of the present invention. Two apparent differences are noticeable immediately. First, a number of openings 200 are provided in the panel of the upper display area 32. Second, a plurality of structures 162*a* to 162*g* are provided, one inside each opening 200. Third, each structure 162*a* to 162*g* is associated with a separate indicator 180*a* to 180*g*. FIGS. 6 and 7 illustrate a view from the front of the upper display area 32 of the cabinet. FIGS. 6 and 7 also illustrate that separate grooves 184 are provided for translational movement of the indicators 180*a* to 180*g*.

Each of the structures 162*a* to 162*g* forms part of the display 160 of this second primary embodiment. The separate structures 162*a* to 162*g* could alternatively be provided on a single structure as shown above. In such a case, only one opening would be provided. In the illustrated embodiment, however, each of the indicators 180*a* to 180*g* is associated with a separate structure 162*a* to 162*g*.

It is also possible for one of the structures to be associated with multiple symbols from a group. For example, a first structure could display the symbols associated with the indicators 180*a* to 180*d* and a second structure could display the symbols associated with the indicators 180*e* to 180*g*. Other combinations can be provided by the implementor.

The structures 162*a* to 162*g* rotate within the gaming device 10 relative to a shaft as described above. In the illustrated embodiment, each surface or side of the structures 162*a* to 162*g* contains and displays a single symbol which is part of one of the symbol groups. As above, the surface or side of the structures 162*a* to 162*g* move or rotate together so as to display sequential groups of symbols. In this embodiment, the individual symbols of the symbol groups are displayed on separate structures.

Although each of the symbols illustrated in connection with FIGS. 6 and 7 are numbers, it should be appreciated that any of the various types of symbols described above could be provided in this second primary embodiment on any one or more of the surfaces of any one or more of the structures.

FIG. 6 illustrates that one of the sides of each of the structures 162*a* to 162*g* is currently substantially flush with or parallel to the plane of the panel of the upper display area 32, i.e., in any indicating position. Further, the indicator 180*c* is illustrated as having moved along its respective groove 184 towards the structure 162*c*. The indicator 180*c* is an indicating position relative to the other indicators. The indicators 180*a*, 180*b* and 180*d* to 180*g* are each in a non-indicating position. If the motion of the second primary embodiment stopped at the point illustrated in FIG. 6, gaming device 10 would provide an output based upon the symbol 30 shown on the structure 162*c*. Although FIG. 6 illustrates two positions, i.e., the indicating position and the non-indicating position, it is also possible that certain of the indicators are in intermediate positions with respect to their structures. For example, the indicators 180*b* and 180*d*, which flank the indicator 180*c* could be in an intermediate position with respect to the structures 162*b* and 162*c*, respectively. In one alternative embodiment, the indicator in the indicating position could be slightly oscillated back and forth to highlight the indicated symbol. This reinforces the selected symbol or outcome.

FIG. 7 illustrates that the structures 162*a* through 162*g* are moving together about a single axis and in mid-rotation between two different sides or surfaces of the structures. As with the first primary embodiment, portions, i.e., the edges between the sides, of the structures 162*a* to 162*g* may extend outside of the surface of the upper display area 32 of the cabinet. The display 160 can include one or more covers such as the cover 102 of FIG. 3B to keep dirt and other contaminants from entering the inside of gaming device 10.

FIG. 7 also illustrates that the lowest indicator 180*g* is in the indicating position, while each of the indicators 180*a* to 180*f* are in the non-indicating position. The second primary embodiment operates similar to the first primary embodiment in that the rotating structures 162*a* to 162*g* provide one random element to the display 160, namely, the presentation of a number of groups of symbols and an ultimate generation of one of the groups of symbols. The indicators 180*a* to 180 *g* provide a second random generation, namely, the selection of one of the symbols from the generated group of symbols.

As illustrated in more detail below, the indicators 180*a* to 180*g* can be controlled by separate motion control devices 58 or the same motion control device 58. If controlled by separate motion control devices, the display 160 and the indicators 180*a* to 180*g* can move independently. For example, the structures 162*a* to 162*g* in an embodiment rotate for a period of time before the indicators 180*a* to 180*g* begin to move. Indicators 180*a* to 180*g* move sequentially in an embodiment, for example, the indicator 180*a* moves first, the indicator 180*b* moves next, the indicator 180*c* moves third, etc. In this manner, the player can eventually discern a pattern or sequence in the movement of the indicators 180*a* to 180*g* and therefore be able to predict which indicator will move next.

A velocity program is provided for the indicators, wherein for example the movement of the indicators 180*a* to 180*g* ramps from a slower speed to a faster speed, so that not only does the horizontal translational speed of the indicators increase but the entire sequence of the relative movement between the indicators would also become quicker. The sequence could then slow down towards the end where the player feels a heightened sense of anticipation as to which symbol of the structures 162*a* to 162*g* will be indicated and provided. The indicators 180*a* to 180*g* can stop moving before or at the same time that the display 160 stops moving, or the display 160 can stop moving before the indicators.

Referring now to FIG. 8, one possible motion control arrangement for the second primary embodiment is illustrated. The view of FIG. 8 is from the inside of the machine at the panel of the upper display area 32. As mentioned above, any of the embodiments disclosed herein can be displayed anywhere on gaming device 10 including the upper display area 32 or on top of the gaming device 10. The cut-outs or openings 200 in the panel can be seen from inside the gaming device 10. The displays 162*a* to 162*g* are also viewable. As stated above, the displays can be single surfaced cylinders or can have any number of surfaces, such as three surfaces or sides.

FIG. 8 illustrates that the displays 162*a* to 162*g* are changing from one surface to another. The displays 162*a* to 162*g* are coupled via collars 166 to a single shaft 164. In the illustrated embodiment, each of the displays 162*a* to 162*g* rotates the same amount as the axis or shaft 164. In one embodiment, the shaft 164 couples via a motor coupler 76 to a motion providing device 58*c*. In an alternative embodiment, various ones of the structures 162*a* to 162*g* could couple to various different motors so that the structures can rotate independently. The shaft 164 is mounted at its other end to bearing 174*a*. The bearing 174*a* is attached to the panel of the upper display area 32 or a structural member thereof.

The indicators 180*a* to 180*g* are held in their non-indicating positions by springs or biasing members 182. Biasing members 182 are attached on one end to a structural member of the upper display area of 32 of the cabinet. The biasing members are attached on the other end to cam followers 186. Cam followers 186 include a portion that is attached to the springs 182 and a portion that extends through the grooves 184 in the panel of the upper display area 32 of the cabinet. The portion of the followers 186 extend through the grooves 184 and attach to indicators 180*a* to 180*g*, which are illustrated here in phantom because they reside on the front side of the panel of the upper display area 32.

Each of the cam followers 186 contact a cam 188 at certain times, which is driven by a lead screw 190 as is well known in the art. Lead screw 190 is attached via a motor coupler 76 to a motion producing device 58*d*, such as a stopper motor. When the shaft of stepper motor 58*d* turns, the lead screw 190 rotates. The cam 188 includes internal threads that thread onto lead screw 190. When lead screw 190 rotates, cam 188 moves along the lead screw 190 towards or away from stepper motor 58*d*. Other than a small amount of backlash that exists due to the bearings in the lead screw 190 and cam 188, the lead screw and cam coupled to the stepper motor provide a very accurate positioning system.

The stepper motor 58*d* controls the acceleration, velocity and position of the cam 188. The size of the cam 188 can be changed to contact one or more followers 186, to thereby move one or more indicators 180*a* to 180*g* at a time. The shape of the cam defines the movement of one or more of the followers and one or more associated indicators. The illustrated embodiment includes two separate motors 58*c* and 58*d* which facilitate independent control as described above.

In an alternative embodiment, mechanical devices such as right angle gears 192*a* and 192*b* are provided so that, for example, motor 58*d* drives both the cam 188 and the structures 162*a* to 162*g*. The ratios of the right angle gears 192*a* and 192*b* are selected so that the structures 162*a* to 162*g* rotate at a desired relative speed with respect to the movement of the cam 188. The right angle gears 192*a* and 192*b* are mounted to the panel of the upper display area 32 or a structural member thereof.

Regardless of whether one or two motion producing devices 58 are provided when the cam 188 contacts one of the followers 186, the follower and the associated indicator move from a non-indicating position towards an indicating position, as currently shown by follower 180*d*. After the cam 188 moves past one of the followers 186 for one of the indicators 180*a* to 180*g*, the spring or biasing member 182 pulls the follower 186 and the associated indicator back towards the non-indicating position. In the illustrated embodiment, one of the indicators 180*a* to 180*g* is in the indicating position, one or more of the indicators is in one or more intermediate positions and the remaining indicators are in non-indicating positions.

When the indicators 180*a* to 180*g* and the structures 162*a* to 162*g* are driven via gears 192*a* and 192*b* by a single motion producing device, the pitch of the lead screw 190 and the gear ratios are structured so that when one of the indicators is in a indicating position, one of the surfaces of each of the structures is flush with the panel of the upper display area 92 and in a position to be indicated. The stepper motors 58*c* and 58*d* can provide encoder feedback to tell the processor 88 exactly where the lead screws 164 and 190 and thus the structures 162*c* to 162*g* are rotationally with respect to a zero reference. The processor 38 also knows, based on which structure 162*a* to 162*g* is indicated and the rotational position of shaft 164, which symbol of the indicated structure is indicated. The processor 38 counts the rotations of shaft 190 and knows exactly where the cam 188 is relative to the structures 162*a* and 162*b*. In an alternative embodiment, one or more positional sensors are provided and used to detect the exact position of the cam 188.

It should be appreciated that in one embodiment of the present invention the gaming device prompts the user to activate an input device which causes the activation of the multi-symbol group structure and the indicator(s).

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device having a game operable upon a wager by a player, said gaming device comprising:

a cabinet;

a mechanical movable structure supported by the cabinet and having a plurality of different symbol groups displayed thereon, a plurality of said symbol groups each having a plurality of symbols, said movable structure operable to move to sequentially indicate each of the symbol groups in a same predefined plane;

a mechanical indicator supported by the cabinet and operable to oscillate relative to the movable structure and independently from the movable structure to indicate one of the symbols from the symbol group indicated by the movable structure; and at least one processor programmed to cause the movable structure to move and then stop moving and position one of the symbol groups in the predefined plane to indicate said symbol group in the predefined plane, to cause the mechanical indicator to oscillate substantially parallel to said predefined plane and then stop oscillating to indicate one of the symbols from said indicated symbol group, and to provide an outcome to the player at least partially based on said indicated symbol.

2. The gaming device of claim 1, which includes an actuator controlled by the processor and operable to move the mechanical movable structure.

3. The gaming device of claim 1, which includes an actuator controlled by the processor and operable to oscillate the mechanical indicator.

4. The gaming device of claim 1, wherein the mechanical movable structure is positioned substantially horizontally relative to the cabinet, and wherein the mechanical indicator is positioned substantially horizontally relative to the cabinet and adjacent to the mechanical movable structure.

5. The gaming device of claim 1, wherein the mechanical movable structure is positioned substantially vertically relative to the cabinet, and wherein the mechanical indicator is positioned substantially vertically relative to the cabinet and adjacent to the mechanical movable structure.

6. The gaming device of claim , wherein the mechanical movable structure and mechanical indicator are operable to move at least partially simultaneously.

7. The gaming device of claim 1, wherein the processor is programmed to cause the mechanical indicator to indicate a plurality of the symbols of at least one of the symbol groups at least one time before stopping to indicate one of the symbols from the indicated symbol group.

8. The gaming device of claim 1, wherein the outcome at least partially based on said indicated symbol from the indicated symbol group is selected from the group consisting of: a designated award associated with said indicated symbol, a selection from a prize pool, at least one free game, an incrementing of a progressive meter, and any combination thereof.

9. The gaming device of claim 1, wherein the movement of the mechanical movable structure and the oscillation of the mechanical indicator are determined at least in part by a random generation.

10. The gaming device of claim 1, wherein the movement of the mechanical movable structure and the oscillation of the mechanical indicator are each individually determined at least in part by a separate random generation.

11. The gaming device of claim 1, which includes a video monitor supported by the cabinet and operable to display a game, wherein the mechanical movable structure moves in conjunction with said game.

12. The gaming device of claim 1, wherein the outcome is part of a secondary game triggered upon the occurrence of triggering event in the game operable upon a wager.

13. The gaming device of claim 1, wherein the mechanical movable structure is prism shaped.

14. The gaming device of claim 1, wherein the mechanical movable structure is operable only to display one symbol group at a time when said mechanical structure stops moving.

15. The gaming device of claim 1, wherein the mechanical movable structure is operable only to indicate one symbol group at a time when said mechanical structure stops moving.

16. The gaming device of claim 1, wherein the mechanical movable structure and the mechanical indicator are operable to move at least partially sequentially.

17. The gaming device of claim 1, wherein the mechanical movable structure and the mechanical indicator are operable to stop moving substantially simultaneously.

18. A gaming device having a game operable upon a wager by a player, said gaming device comprising:

a cabinet;

a mechanical rotatable structure supported by the cabinet and having a plurality of different symbol groups displayed thereon, a plurality of said symbol groups each having a plurality of symbols, said rotatable structure operable to rotate to sequentially indicate each of the symbol groups in a same predefined plane;

a mechanical indicator supported by the cabinet and operable to oscillate relative to the rotatable structure and independently from the rotatable structure to indicate one of the symbols from the symbol group indicated by the rotatable structure; and at least one processor programmed to cause the rotatable structure to rotate and then stop rotating to position one of the symbol groups in the predefined plane to indicate said symbol groups in the predefined plane, to cause the mechanical indicator to oscillate substantially parallel to said predefined plane and then to stop oscillating to indicate one of the symbols from said indicated symbol group, and to provide an outcome to the player at least partially based on said indicated symbol.

19. The gaming device of claim 18, which includes an actuator controlled by the processor and operable to rotate the mechanical rotatable structure.

20. The gaming device of claim 18, which includes an actuator controlled by the processor and operable to oscillate the mechanical indicator.

21. The gaming device of claim 18, wherein the mechanical rotatable structure is positioned substantially horizontally relative to the cabinet, and wherein the mechanical indicator is positioned substantially horizontally relative to the cabinet and adjacent to the mechanical rotatable structure.

22. The gaming device of claim 18, wherein the mechanical movable structure is positioned substantially vertically relative to the cabinet, and wherein the mechanical indicator is positioned substantially vertically relative to the cabinet and adjacent to the mechanical movable structure.

23. The gaming device of claim 18, wherein the mechanical rotatable structure and mechanical indicator are operable to move at least partially simultaneously.

24. The gaming device of claim 18, wherein the processor is programmed to cause the mechanical indicator to indicate a plurality of the symbols of at least one of the symbol groups at least one time before stopping to indicate one of the symbols from the indicated symbol group.

25. The gaming device of claim 18, wherein the outcome at least partially based on the indicated symbol from the indicated symbol group is selected from the group consisting of: a designated award associated with said indicated symbol, a selection from a prize pool, at least one free game, an incrementing of a progressive meter, and any combination thereof.

26. The gaming device of claim 18, wherein the rotation of the mechanical rotatable structure and the oscillation of the mechanical indicator are determined at least in part by a random generation.

27. The gaming device of claim 18, wherein the rotation of the mechanical rotatable structure and the oscillation of the mechanical indicator are each individually determined at least in part by a separate random generation.

28. The gaming device of claim 18, which includes a video monitor supported by the cabinet and operable to display a game, wherein the mechanical rotatable structure rotates in conjunction with said game.

29. The gaming device of claim 18, wherein the outcome is part of a secondary game triggered upon the occurrence of triggering event in the game operable upon a wager.

30. The gaming device of claim 18, wherein the mechanical rotatable structure is prism shaped.

31. The gaming device of claim 18, wherein the mechanical rotatable structure is operable to only display one symbol group at a time when said mechanical structure stops rotating.

32. The gaming device of claim 18, wherein the mechanical rotatable structure is operable to only indicate one symbol group at a time when said mechanical structure stops rotating.

33. The gaming device of claim 18, wherein the mechanical rotatable structure and the mechanical indicator are operable to move at least partially sequentially.

34. The gaming device of claim 18, wherein the mechanical rotatable structure and the mechanical indicator are operable to stop moving substantially simultaneously.

35. A gaming device having a game operable upon a wager by a player, said gaming device comprising:

a cabinet;

a mechanical movable structure supported by the cabinet and having a plurality of different symbol groups displayed thereon, a plurality of said symbol groups each having a plurality of symbols, said movable structure operable to move to sequentially indicate each of the symbol groups in a same predefined plane;

a mechanical indicator supported by the cabinet and operable to oscillate relative to the movable structure and independently from the movable structure; and at least one processor programmed to cause the mechanical indicator to oscillate substantially parallel to said predefined plane and then stop oscillating, to cause the movable structure to move and then stop moving to position one of the symbol groups in the predefined plane to indicate said symbol group in said predefined plane and such that the mechanical indicator indicates one of the symbols from said indicated symbol group, and to provide an outcome to the player at least partially based on said indicated symbol.

36. The gaming device of claim 35, which includes an actuator controlled by the processor and operable to move the mechanical movable structure.

37. The gaming device of claim 35, which includes an actuator controlled by the processor and operable to oscillate the mechanical indicator.

38. The gaming device of claim 35, wherein the mechanical movable structure is positioned substantially horizontally relative to the cabinet, and wherein the mechanical indicator is positioned substantially horizontally relative to the cabinet and adjacent to the mechanical movable structure.

39. The gaming device of claim 35, wherein the mechanical movable structure is positioned substantially vertically relative to the cabinet, and wherein the mechanical indicator is positioned substantially vertically relative to the cabinet and adjacent to the mechanical movable structure.

40. The gaming device of claim 35, wherein the mechanical movable structure and mechanical indicator are operable to move at least partially simultaneously.

41. The gaming device of claim 35, wherein the processor is programmed to cause the mechanical indicator to indicate a plurality of the symbols of at least one of the symbol groups at least one time before stopping to indicate one of the symbols from the indicated symbol group.

42. The gaming device of claim 35, wherein the outcome at least partially based on said indicated symbol from the indicated symbol group is selected from the group consisting of: a designated award associated with said indicated symbol, a selection from a prize pool, at least one free game, an incrementing of a progressive meter, and any combination thereof.

43. The gaming device of claim 35, wherein the movement of the mechanical movable structure and the oscillation of the mechanical indicator are determined at least in part by a random generation.

44. The gaming device of claim 35, wherein the movement of the mechanical movable structure and the oscillation of the mechanical indicator are each individually determined at least in part by a separate random generation.

45. The gaming device of claim 35, which includes a video monitor supported by the cabinet and operable to display a game, wherein the mechanical movable structure moves in conjunction with said game.

46. The gaming device of claim 35, wherein the outcome is part of a secondary game triggered upon the occurrence of triggering event in the game operable upon a wager.

47. The gaming device of claim 35, wherein the mechanical movable structure is prism shaped.

48. The gaming device of claim 35, wherein the mechanical movable structure is operable to only display one symbol group at a time when said mechanical structure stops moving.

49. The gaming device of claim 35, wherein the mechanical movable structure is operable to only indicate one symbol group at a time when said mechanical structure stops moving.

50. The gaming device of claim 35, wherein the mechanical movable structure and the mechanical indicator are operable to move at least partially sequentially.

51. The gaming device of claim 35, wherein the mechanical movable structure and the mechanical indicator are operable to stop moving substantially simultaneously.

52. A gaming device having a game operable upon a wager by a player, said gaming device comprising:

a cabinet;

a mechanical rotatable structure supported by the cabinet and having a plurality of different symbol groups displayed thereon, a plurality of said symbol groups each having a plurality of symbols, said rotatable structure operable to rotate to sequentially indicate each of the symbol groups in a same predefined plane;

a mechanical indicator supported by the cabinet and operable to oscillate relative to the rotatable structure and independently from the rotatable structure; and at least one processor programmed to cause the mechanical indicator to oscillate substantially parallel to said predefined plane and then to stop oscillating, to cause the rotatable structure to rotate and then stop rotating to position one of the symbol groups in the predefined plane to indicate said symbols group in said predefined plane, such that the mechanical structure indicates one of the symbols from said indicated symbol group, and to provide an outcome to the player at least partially based on said indicated symbol.

53. The gaming device of claim 52, which includes an actuator controlled by the processor and operable to rotate the mechanical rotatable structure.

54. The gaming device of claim 52, which includes an actuator controlled by the processor and operable to oscillate the mechanical indicator.

55. The gaming device of claim 52, wherein the mechanical rotatable structure is positioned substantially horizontally relative to the cabinet, and wherein the mechanical indicator is positioned substantially horizontally relative to the cabinet and adjacent to the mechanical rotatable structure.

56. The gaming device of claim 52, wherein the mechanical rotatable structure is positioned substantially vertically relative to the cabinet, and wherein the mechanical indicator is positioned substantially vertically relative to the cabinet and adjacent to the mechanical rotatable structure.

57. The gaming device of claim 52, wherein the mechanical rotatable structure and mechanical indicator are operable to move at least partially simultaneously.

58. The gaming device of claim 52, wherein the processor is programmed to cause the mechanical indicator to indicate a plurality of the symbols of at least one of the symbol groups at least one time before stopping to indicate one of the symbols from the indicated symbol group.

59. The gaming device of claim 52, wherein the outcome at least partially based on the indicated symbol from the indicated symbol group is selected from the group consisting of: a designated award associated with said indicated symbol, a selection from a prize pool, at least one free game, an incrementing of a progressive meter, and any combination thereof.

60. The gaming device of claim 52, wherein the rotation of the mechanical rotatable structure and the oscillation of the mechanical indicator are determined at least in part by a random generation.

61. The gaming device of claim 52, wherein the rotation of the mechanical rotatable structure and the oscillation of the mechanical indicator are each individually determined at least in part by a separate random generation.

62. The gaming device of claim 52, which includes a video monitor supported by the cabinet and operable to display a game, wherein the mechanical rotatable structure rotates in conjunction with said game.

63. The gaming device of claim 52, wherein the outcome is part of a secondary game triggered upon the occurrence of triggering event in the game operable upon a wager.

64. The gaming device of claim 52, wherein the mechanical rotatable structure is prism shaped.

65. The gaming device of claim 52, wherein the mechanical rotatable structure is operable to only display one symbol group at a time when said mechanical structure stops rotating.

66. The gaming device of claim 52, wherein the mechanical rotatable structure is operable to only indicate one symbol group at a time when said mechanical structure stops rotating.

67. The gaming device of claim 52, wherein the mechanical rotatable structure and the mechanical indicator are operable to move at least partially sequentially.

68. The gaming device of claim 52, wherein the mechanical rotatable structure and the mechanical indicator are operable to stop moving substantially simultaneously.

* * * * *

UNITED STATES PATENT AND TRADEMARK OFFICE

CERTIFICATE OF CORRECTION

PATENT NO. : 7,169,045 B2
APPLICATION NO. : 10/800593
DATED : January 30, 2007
INVENTOR(S) : Dennis Nordman It is certified that error appears in the above-identified patent and that said Letters Patent is hereby corrected as shown below:

In column 1, line 50, change “player to bonus game” to --player to base game--.

In column 7, line 42, change “end walls 70 of 62” to --end walls 70 or 62--.

In column 8, line 44, change “is in one embodiment” to --as in one embodiment--.

In column 12, line 4, change “that enter the through” to --that enter through--.

IN THE CLAIMS:

In Claim 6, column 16, line 3, change “claim,” to --claim 1,--.

Signed and Sealed this

Twenty-first Day of August, 2007

JON W. DUDAS
*Director of the United States Patent and Trademark Office*